US007021263B1

(12) United States Patent
Agnew et al.

(10) Patent No.: US 7,021,263 B1
(45) Date of Patent: Apr. 4, 2006

(54) ENGINE MANIFOLD WITH INTERCHANGEABLE PORTING PORTION

(75) Inventors: Dan Agnew, Rochester Hills, MI (US); Tim Collins, Rochester Hills, MI (US)

(73) Assignee: Competition Cams, Inc., Memphis, TN (US)

( * ) Notice: Subject to any disclaimer, the term of this patent is extended or adjusted under 35 U.S.C. 154(b) by 0 days.

(21) Appl. No.: 10/976,361

(22) Filed: Oct. 29, 2004

(51) Int. Cl.
*F02M 35/10* (2006.01)

(52) U.S. Cl. ..... 123/184.47; 123/184.34

(58) Field of Classification Search ..... 123/184.21, 123/184.34, 184.42, 184.47
See application file for complete search history.

(56) References Cited

U.S. PATENT DOCUMENTS 3,831,566 A 8/1974 Thomas
6,161,513 A * 12/2000 Lohr et al. ..... 123/184.34
6,679,215 B1 1/2004 Benson et al.

OTHER PUBLICATIONS

US 2,279,224, 07/1981, Szabo et al. (withdrawn)

* cited by examiner

*Primary Examiner*—Noah P. Kamen
(74) *Attorney, Agent, or Firm*—Arent Fox PLLC

(57) ABSTRACT

A modular intake manifold for an internal combustion engine that has a lower base member, a center runner section, and an upper shell. The lower base member has a series of outlets and witness marks formed within the outlets and attaches to an engine between right and left cylinder heads. The center runner section is situated within the base member for channeling incoming air into the series of outlets in the lower base member. The upper shell attaches to the lower base member, includes a throttle body mounting boss, seals and isolates the individual runner sections of the center runner section, and encloses the intake manifold. The intake manifold may be assembled and disassembled freely. Once disassembled, a different upper shell or center runner section, each having differing features from the components previously removed, may be reattached to the lower base member to alter the engine performance in some way.

15 Claims, 9 Drawing Sheets

ENGINE MANIFOLD WITH INTERCHANGEABLE PORTING PORTION

BACKGROUND OF THE INVENTION

1. Field of the Invention

The present invention relates to an intake manifold for an internal combustion engine and, more particularly, to a manifold having interchangeable parts capable of disassembly and reassembly.

2. Discussion of Related Art

Internal combustion engines generally include an intake manifold. The intake manifold directs air or a fuel and air mixture into the cylinders of the engines where the fuel and air mixture is combusted, releasing mechanical energy to power the engine.

Traditionally, intake manifolds have been made by either casting metals into a single component or by forming plastics or polymers into several different pieces that are then permanently bonded together by, for example, friction welding. Any subsequent attempt to disassemble either of the traditional types results in severe damage to the intake manifold. Therefore, these construction types precluded the intake manifold from being tuned to alter engine performance in any way alterations such as clearing or removing excess metal or other material or removing and discarding the current intake manifold and obtaining and installing a new intake manifold. Such replacement is both costly and wasteful. Additionally, removal of the old intake manifold destroys the seal between the intake manifold and the engine. This exposes internal components of the engine to external debris and contamination. Currently, then, in order to tune engine performance by means of the intake manifold, a user must essentially purchase an entirely new intake manifold part and subject the engine to potential damage from external contamination. Therefore, tuning by manipulation of the intake manifold, i.e., intake runner length or intake diameter, becomes financially costly and prone to cause engine damage.

Prior art patents disclosing multipiece intake manifolds capable of being disassembled are known, such as U.S. Pat. No. 3,831,566 issued to Thomas and U.S. Pat. No. 4,279,224 issued to Szabo et al. However, none of these patents provides for a manifold comprising easily removed and replaced components having differing characteristics, such as air inlet size and internal runner shape, to alter engine performance.

SUMMARY OF THE INVENTION

The instant invention provides an improved intake manifold for an internal combustion engine that solves the above-described problems, as well as others, by having a construction that permits disassembly, replacement or substitution, and reassembly without detriment to the individual intake manifold components.

According to a first aspect of the invention, an intake manifold has a multiple piece construction comprising, for example, a lower base member, a center runner section, and an upper shell, wherein the upper shell and center runner section fixably attach, for example by the use of bolts, to the lower base member in such a way that the components can later be disassembled. This ability to disassemble the intake manifold without causing damage allows intake manifold tuning by reattaching to the lower base member a different upper shell or center runner section having different geometries. For example, the instant invention allows for transmittal of a larger volume of air through the intake manifold by replacing the upper shell with an upper shell having a larger inlet. Additionally, replacing the center runner section with a center runner section having runner cavities of a different shape changes the airflow within the intake manifold and, hence, the way in which the air is delivered to the engine. This also provides flexibility for engine tuning. Therefore, the interchangeability of the upper shell and the center runner section is advantageous from an engine tuning perspective and results in less waste compared to traditional intake manifolds that must be entirely replaced. Further, the modular construction of the intake manifold allows for the removal and replacement of the upper shell without detaching the lower base member from the engine. Hence the seal between the lower base member and the engine remains intact, thereby reducing the possibility of debris entering the engine.

A second aspect of the invention is the use of witness marks on interior surfaces of air outlets of the lower base member to provide visual indicators of the amount of material that can be safely removed from the interior surfaces before the intake manifold will no longer seal with the internal combustion engine.

Additional advantages and novel features of the invention will be partially set forth in the description that follows, and will also become apparent to those skilled in the art upon examination of the following or upon learning by practice of the invention.

BRIEF DESCRIPTION OF DRAWINGS

Other aspects of the present invention will be better understood from the following description, along with the accompanying drawings, wherein.

DETAILED DESCRIPTION OF THE INVENTION

Figure 1:
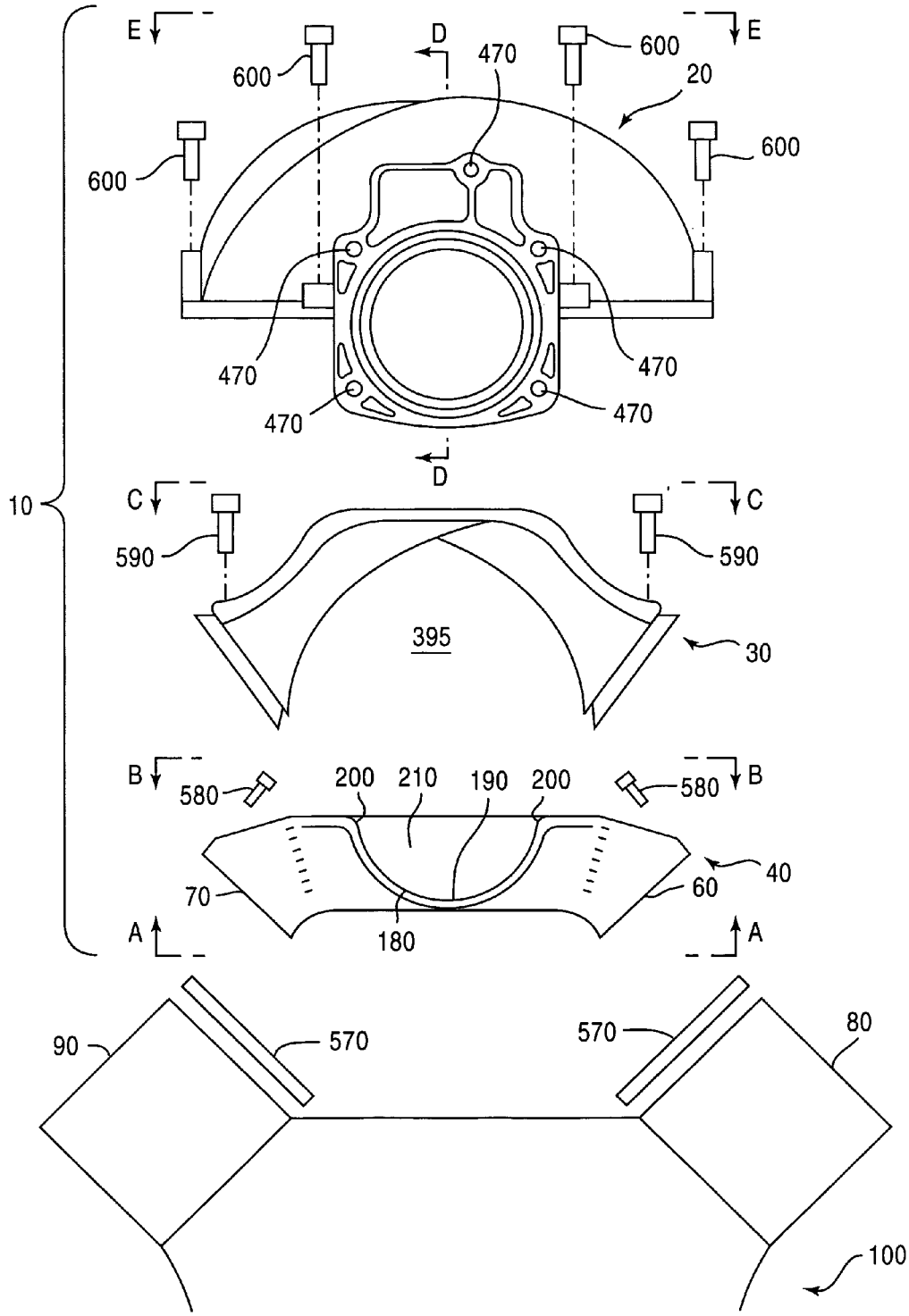
FIG. 1 is an exploded view of an embodiment of the intake manifold in accordance with an embodiment of the present invention.

The embodiment described below applies to a three-piece intake manifold for an eight-cylinder internal combustion engine. However, it is understood that the invention is applicable to an internal combustion engine having any number of cylinders. FIG. 1 is an exploded view of a first embodiment of the intake manifold 10 of the present invention, having an upper shell 20, a center runner section 30, and a lower base member 40. The center runner section 30 inserts into lower base member 40. Upper shell 20 secures to an upper mating surface 50 of lower base member 40 and encloses the center runner section 30 between the upper shell 20 and the lower base member 40.

Lower Base Member

Figure 2:
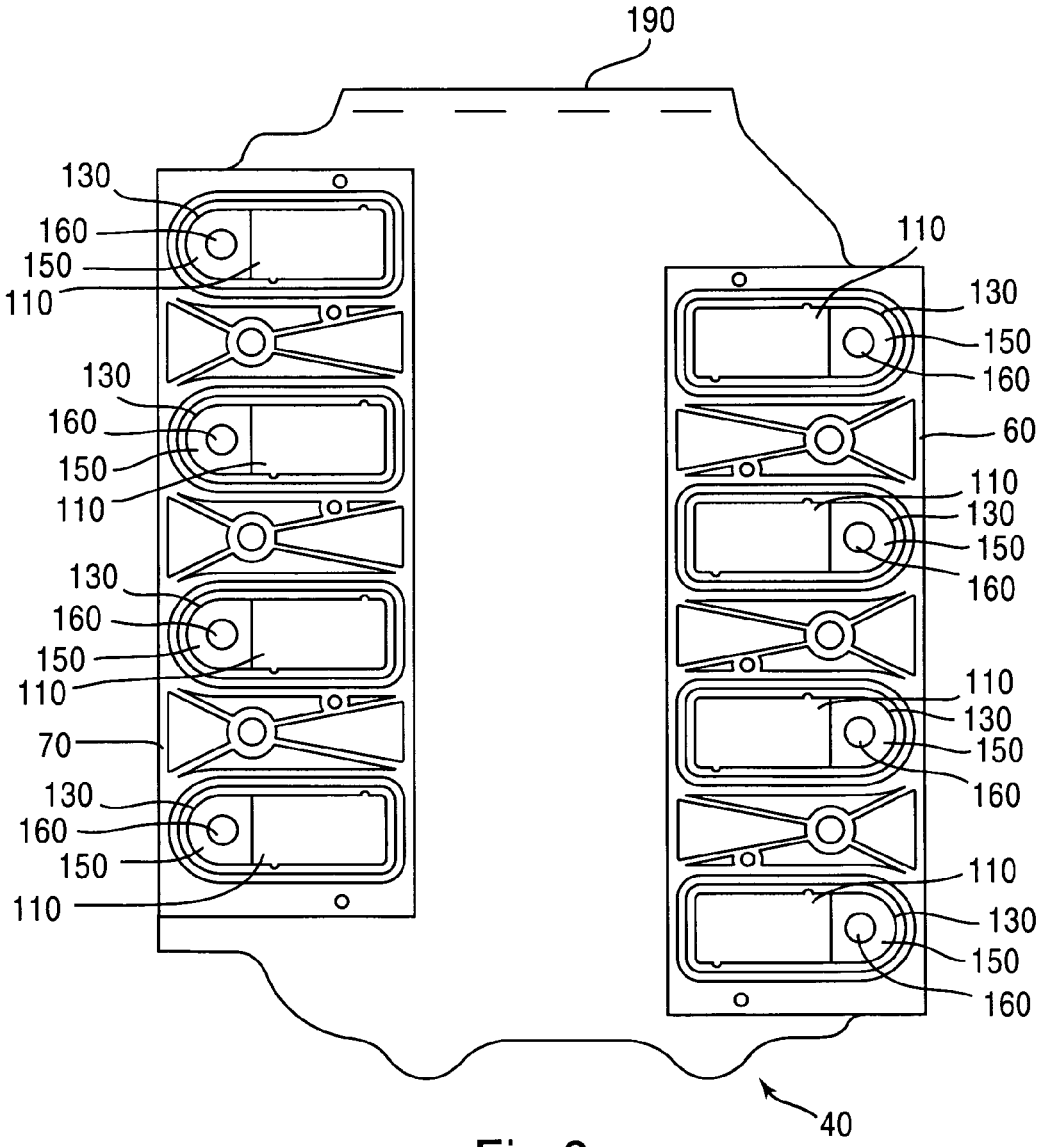
FIG. 2 is a view along line A—A in FIG. 1.
Figure 3:
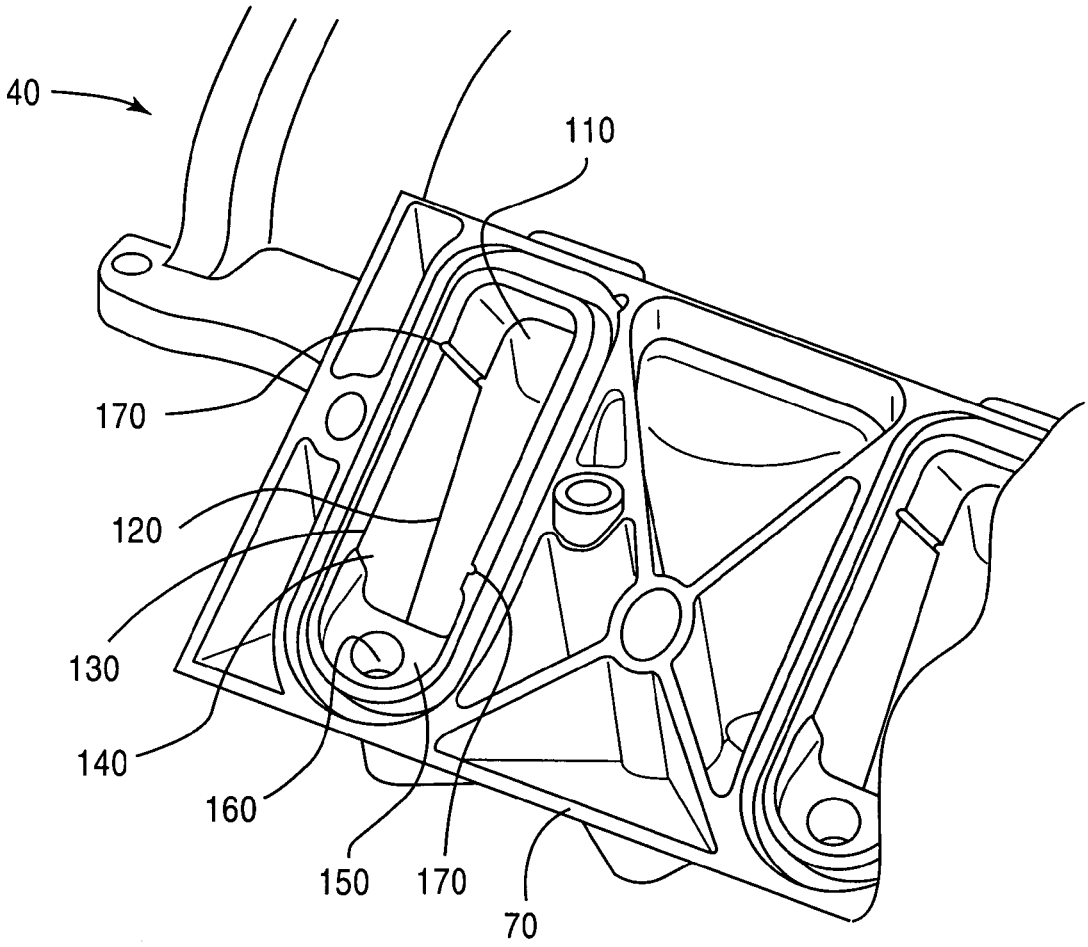
FIG. 3 is a partial detail view of the mating face of the lower base member for the embodiment of FIG. 1.
Figure 4:
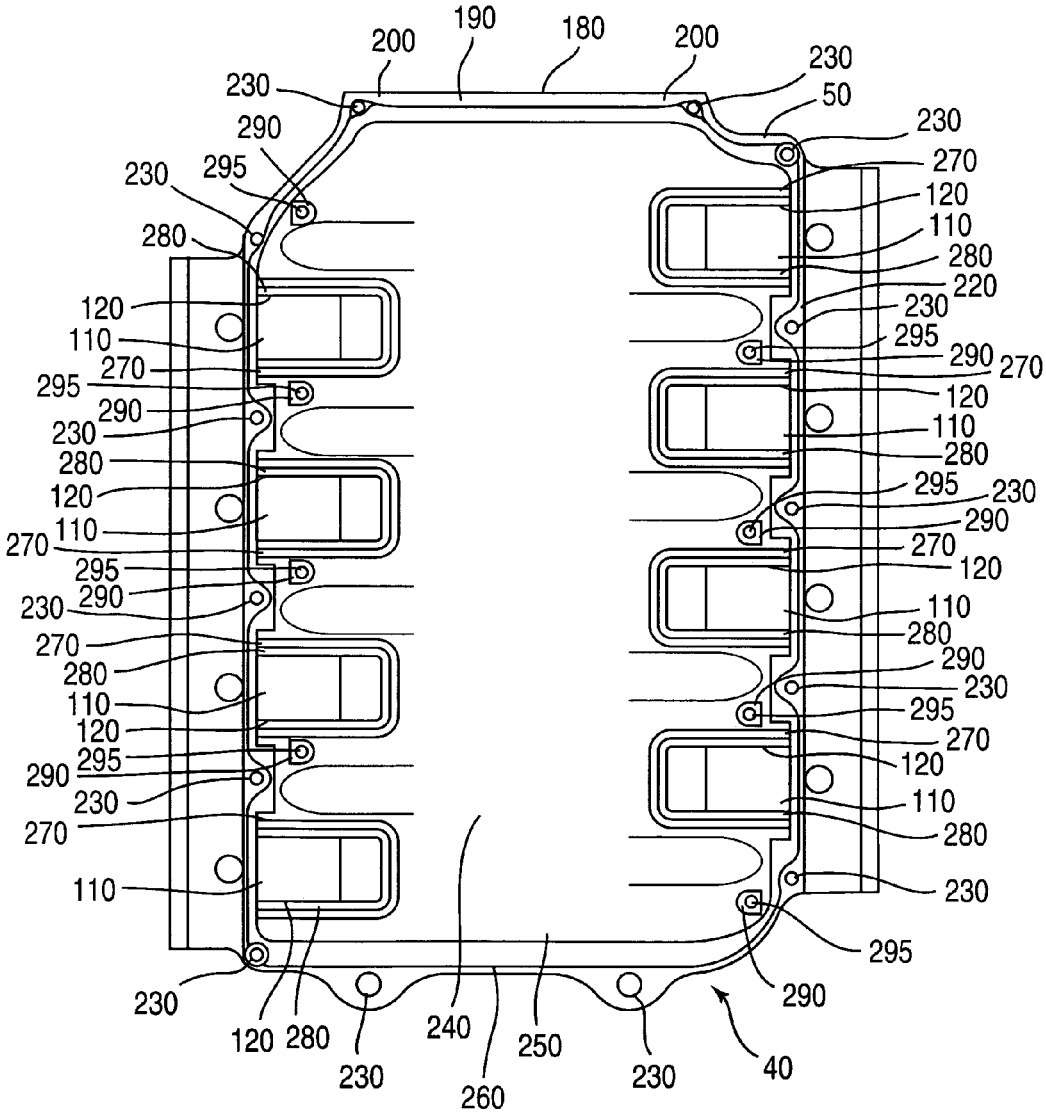
FIG. 4 is a view along line B—B in FIG. 1.

FIG. 2 corresponds to view A—A of FIG. 1 and is a bottom view of the lower base member 40. Referring to FIG. 2, lower base member 40 includes right 60 and left 70 mating faces that abut mating surfaces on right 80 and left 90 cylinder heads of an engine 100, as shown in FIG. 1. Air outlets 110 are provided within the lower base member 40. As shown in FIGS. 3 and 4 the air outlets 110 have an upper edge 120 and a lower edge 130, as well as an interior surface 140 extending from the upper edge 120 to the lower edge 130. Lower edges 130 of air outlets 110 correspond to inlet ports (not shown) provided in the cylinder heads 80 and 90. Thus, the air outlets 110 are passages extending through the entire thickness of lower base member 40, and allow communication between the interior of the intake manifold 10 and the inlet ports of cylinder heads 80 and 90. Surfaces 150 are also provided within an outer periphery of the air outlets 110 near the outer periphery of the mating faces 60 and 70. An opening 160 extends from each surface 150 through the entire thickness of lower base member 40.

Referring to FIG. 3, two witness marks 170 are formed into the interior surfaces 140 of the air outlets 110. The witness marks are formed, for example, by being cast into the lower base member 40 at the time of manufacturing or by a machining process after formation of the lower base member 40. The function of the witness marks 170 will be explained further below.

FIG. 4 corresponds to view B—B of FIG. 1 and is a top view of the lower base member 40. Referring to FIGS. 1 and 4, a semicircular flange 180 having an upper surface 190 and rounded upper surfaces 200 is formed at the front of the lower base member 40 and creates a semicircular front opening 210, as shown in FIG. 1. An upper surface 220 of the lower base member 40 along with the upper surface 190 of the flange 180 and rounded upper surfaces 225 comprise the upper mating surface 50. A series of threaded openings 230 are formed in the upper mating surface 50. The interior of lower base member 40 includes a large central cavity 240 having a base defined by an upper interior surface 250 of the lower base member 40. The interior of lower base member 40 communicates with the exterior of the lower base member 40 by the front opening 210, the air outlets 110, and an opening formed by an inner edge of the upper surface 220. A continuous groove 260 is formed in the upper mating surface 50.

Turning to the interior of the lower base member 40, the upper edges 120 of the air outlets 110 are provided on the upper interior surface 250 and are surrounded on three sides by a groove 270 formed in the upper interior surface 250. Therefore, the grooves 270 form a U-shape leaving only the outermost edge of the upper edge 120 unbounded. The area between the grooves 270 and the upper edges 120 of the air outlets 110 form mating surfaces 280. Additionally, a series of bosses 290 integrally formed on the upper interior surface 250 are proximate to the inner edge of upper surface 220. A threaded opening 295 exists on each of the bosses 290 and extends into the lower base member 40.

Center Runner Section

Figure 5:
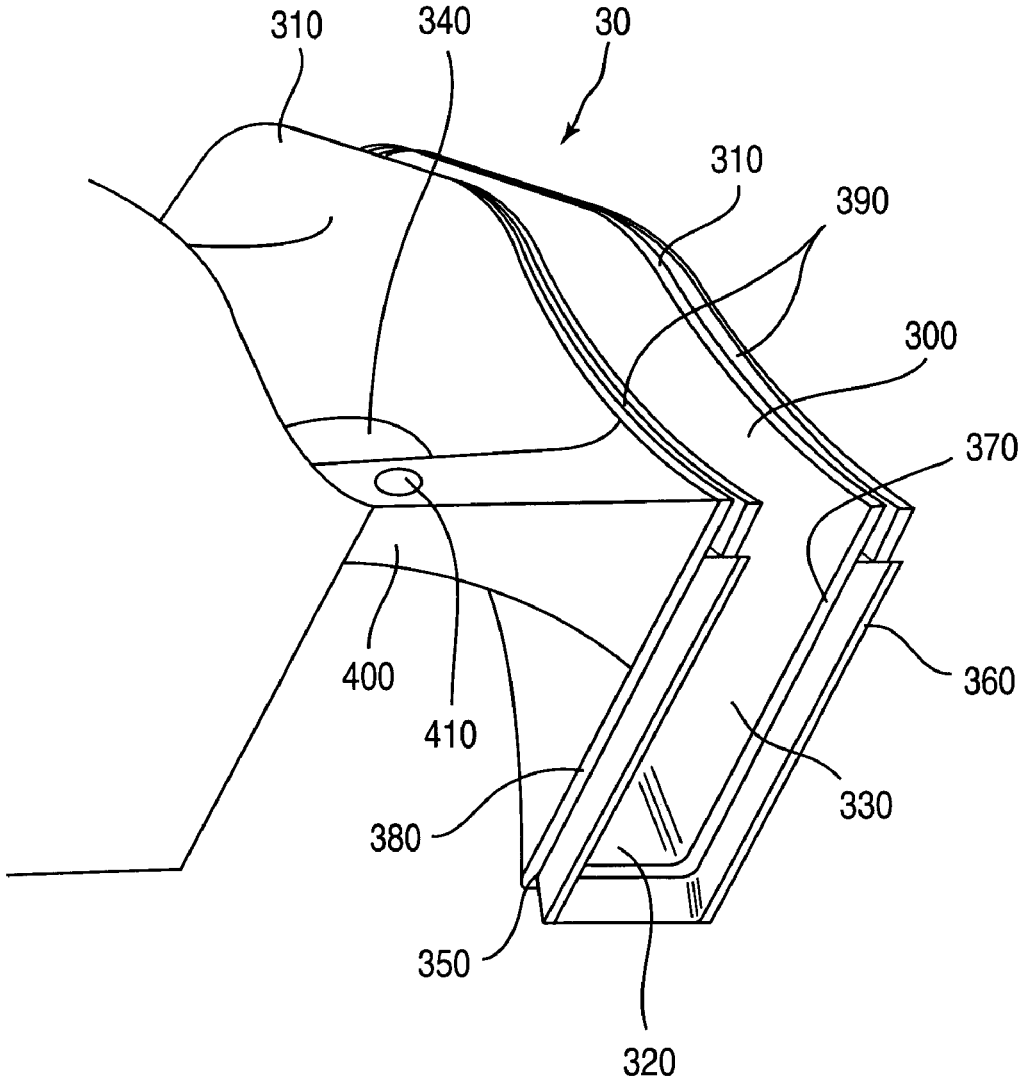
FIG. 5 is a partial detail view of an outlet of a runner cavity of the center runner section for the embodiment of FIG. 1.
Figure 6:
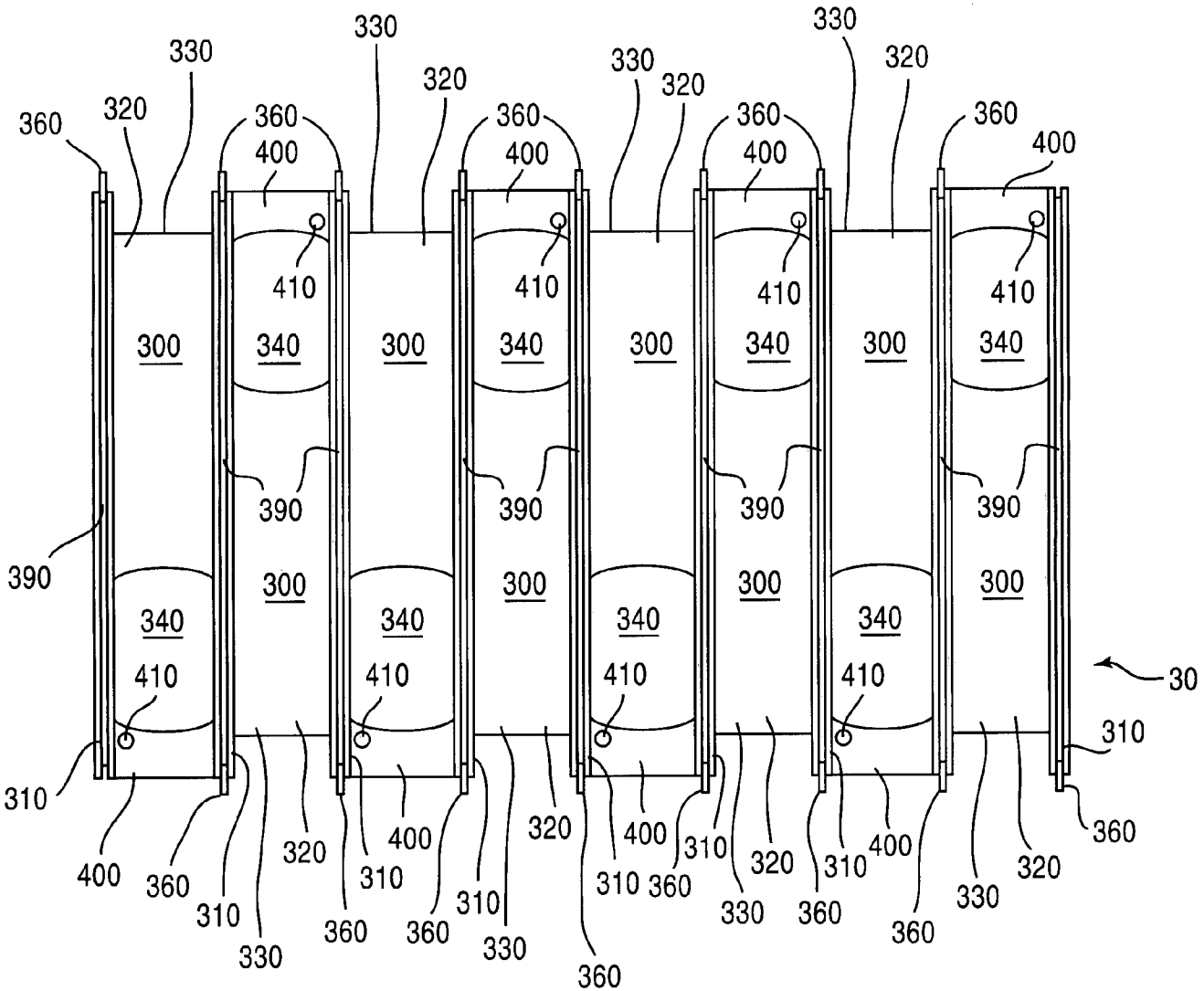
FIG. 6 is a view along line C—C in FIG. 1.
Figure 7:
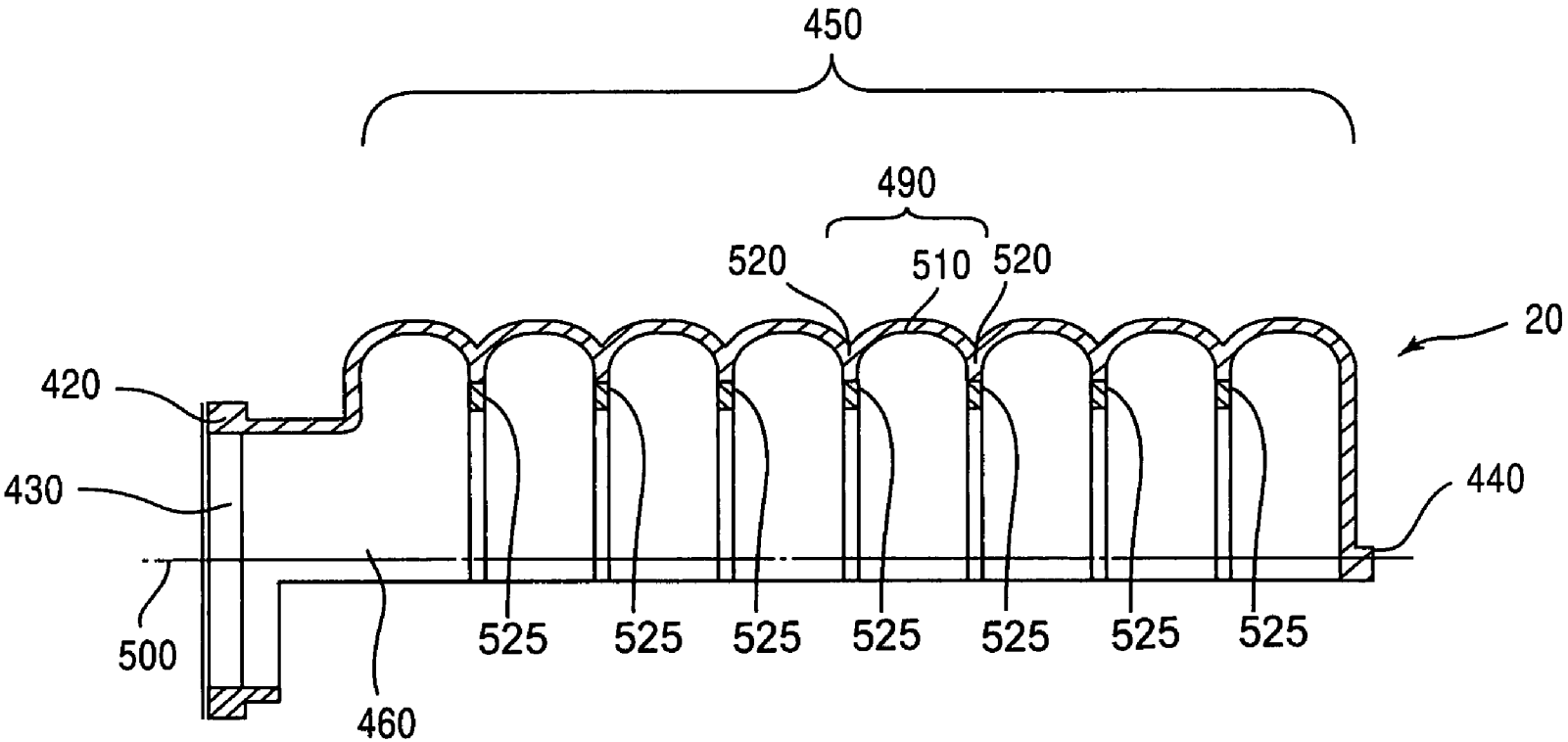
FIG. 7 is a section view along line D—D in FIG. 1.

FIGS. 1, 5, and 6 illustrate the center runner section 30. The center runner section 30 is the base of the intake manifold and can comprise various types of materials, such as metal, plastic, or polymers. In a preferred embodiment, the center runner section 30 is a single piece component manufactured by any number of well known casting or molding techniques. FIG. 5 is a partial detail of a portion of the center runner section 30, and FIG. 6 is a view along line C—C in FIG. 1. The center runner section 30 includes a series of runner cavities 300 having substantially a U-shaped cross-section defined by vertical walls 310 and a base 320. Each runner cavity 300 has an outlet 330 at one end and an inlet 340 at an opposing end. It is understood that a surface of one vertical wall 310 forms an inner vertical surface of one runner cavity 300, while an opposite surface of the same vertical wall 310 forms an inner vertical surface for an adjacent runner cavity 300. In one embodiment, adjacent runner cavities 300 are oriented in opposite directions from one another, so that one runner cavity 300 extends to one side of the lower base member 40, while an adjacent runner cavity 300 extends to the opposite side of lower base member 40. An end surface 350 is formed at each outlet 330 by terminal ends of the vertical walls 310 and the base 320. A flange 360 extends from the center of each end surface 350 and has a cross-section thickness less than the width of the end surface 350. Therefore, the flanges 360 divide the end surfaces 350 into an inner mating surface 370 and an outer mating surface 380. A groove 390 is formed on an upper surface of each vertical wall 310.

As illustrated in FIG. 1, the center runner section 30 has a general arc shape defining an air intake and distribution chamber 395 below the runner cavities 300. The air intake and distribution chamber 395 communicates with the runner cavities 300 via the inlets 340. A wall 400 extends from a horizontal surface of each vertical wall 310 to an opposing horizontal surface of an adjacent vertical wall 310 enclosing the inlets 340. An opening 410 extends through each wall 400 from a top surface.

Upper Shell

Figure 8:
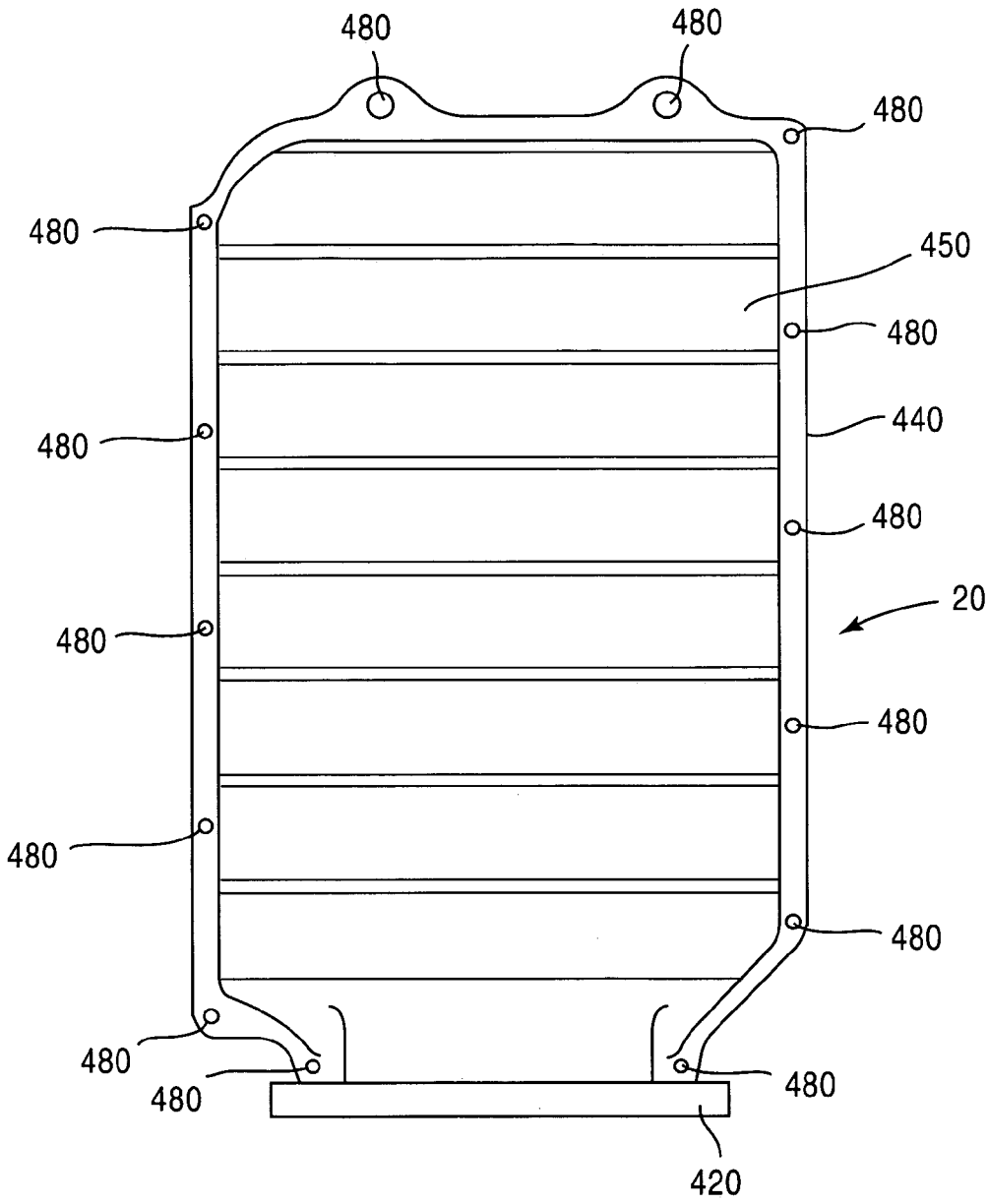
FIG. 8 is a view along line E—E in FIG. 1.

The upper shell 20, which can be composed of various types of materials, such as metal, plastic, or polymers, encloses the manifold 10 from above. In a preferred embodiment, the upper shell 20 is formed as a single piece component manufactured by any number of well-known casting or molding techniques. FIGS. 1, 7, 8, and 9 illustrate the upper shell 20, which is comprised of a throttle body mounting boss 420, an inlet 430, a peripheral mating flange 440, a contoured upper portion 450, and an interior cavity 460. The inlet 430 communicates with the interior cavity 460. Additionally, in one embodiment inlet 430 is secondly circular in shape. However, the inlet 430 of the instant invention can be of any shape. As illustrated in FIG. 1, a series of threaded openings 470 extend through the throttle body mounting boss 420 from a front face and accept bolts (not shown) or other fasteners used to attach a throttle body (not shown) to the upper shell 20. FIG. 8 is view E—E shown in FIG. 1 and illustrates a series of openings 480 extending through the mating flange 440 from an upper surface. The upper portion 450 comprises a series of integrally formed semicircular covers 490 that are transverse to a longitudinal axis 500 and extend from an edge of the mating flange 440 to an opposing edge on the mating flange 440. Each cover 490 corresponds to a runner cavity 300 of the center runner section 30 and is comprised of an upper surface 510 and opposing horizontal surfaces of vertical walls 520 extending from a lower surface of the upper portion 450. A seal 525 extends into the interior cavity 460 from a bottom surface of each vertical wall 520.

Figure 9:
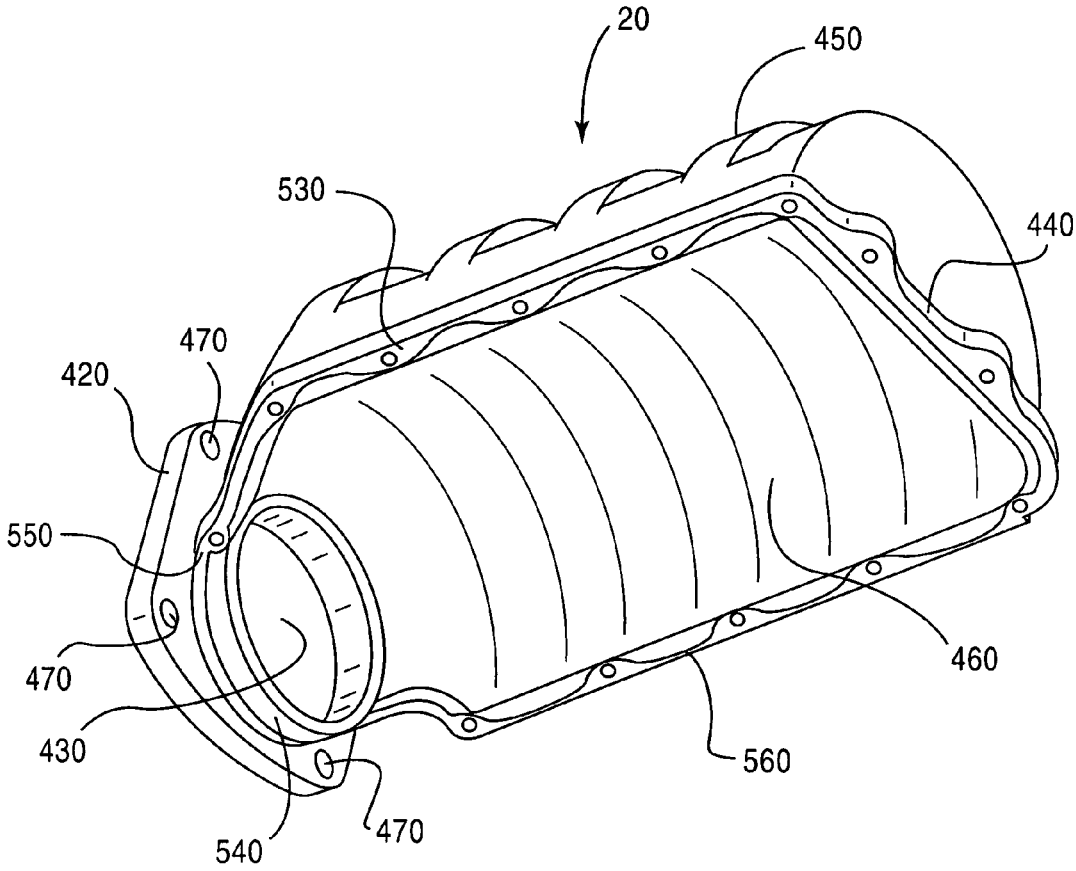
FIG. 9 is an isometric view of the upper shell of an intake manifold, in accordance with an embodiment of the present invention.

FIG. 9 is an isometric view of the upper shell 20 and illustrates a continuous lower mating surface 530, comprised of a lower surface of the mating flange 440, a lower semicircular surface 540, and rounded surfaces 550. A seal 560 is disposed on the lower mating surface 530.

Manifold Assembly

According to FIG. 1, the lower base member 40 attaches to the engine 100 between the cylinder heads 80 and 90. The mating faces 60 and 70 engage corresponding mating surfaces on the cylinder heads 80 and 90 with a series of gaskets 570 or other sealing mechanisms provided there between. When the lower base member 40 is properly positioned on the engine 100, openings 160 align with corresponding threaded openings (not shown) in the cylinder heads 80 and 90 of the engine 100. Bolts 580, for example, insert through the openings 160 from above and screw into the corresponding threaded opening in the cylinder heads 80 and 90, creating a seal at the interface of the mating faces 60 and 70, the gaskets 570, and the mating surfaces of the cylinder heads 80 and 90. Further, as previously described, the lower edges 130 of the air outlets 110 align with corresponding inlet ports in the cylinder heads 80 and 90 of the engine 100, allowing communication between the interior of both the intake manifold 10 and the engine 100.

Next, the center runner section 30 inserts into and attaches to the lower base member 40. Prior to attaching center runner section 30 to lower base member 40, a sealant, such as silicone gel, is applied to the flanges 360 at the outlets 330 of the runner cavities 300 of the center runner section 30. After insertion, the flanges 360 insert into the U-shaped grooves 270 provided in the lower base member 40, causing contact between inner mating surfaces 370 of the runner cavities 300 and mating surfaces 280 of the lower base member 40, and between the outer mating surfaces 380 and the upper interior surface 250 of the lower base member 40 adjacent to the grooves 270. Once the center runner section 30 is inserted, the sealant creates a seal between the outlets 330 of the center runner section 30 and the air outlets 110 of the lower base member 40. Further, openings 410 extending through the walls 400 of the center runner section 30 align with the threaded openings 295 provided on the bosses 290 integral to the upper interior surface 250 of the lower base member 40. Bolts 590, for example, insert through openings 410 from above and screw into threaded openings 295, securely attaching the center runner section 30 to the lower base member 40. Moreover, inner edges of the inner mating surface 370 at the outlets 330 align with the upper edges 120 of the air outlets 110 of the lower base member 40, providing a smooth transition between the runner cavities 300 and the air outlets 110.

Finally, upper shell 20 attaches to the lower base member 40 from above, completely enclosing the center runner section 30. When properly oriented, the lower mating surface 530 of the upper shell 20 contacts upper mating surface 50 of the lower base member 40, forcing the seal 560 into the groove 260, creating a seal. Additionally, openings 480 in the mating flange 440 align with the threaded openings 230 in the upper mating surface 50. Bolts 600, for example, insert into openings 480 from above and screw into threaded openings 230, providing a clamping force to hold the engine manifold 10 together. Further, when the upper shell 20 is placed down onto the assembly of the lower base member 40 and the center runner section 30, the seals 525 provided on the lower surfaces of the vertical walls 520 align and insert into the corresponding grooves 390 formed in the upper surface of each vertical wall 310 of the center runner section 30. Once attached, the upper shell 20 completely encloses and seals the runner cavities 300 of the center runner section 30 via the upper surfaces 510 and vertical walls 520 of the upper shell 20. Therefore, both the center runner section 30 and the upper shell 20 attach directly to the lower base member 40, thereby allowing assembly and disassembly of the upper shell 20 without disturbing the center runner section 30 or lower base member 40.

When assembled, the interior of the intake manifold 10 communicates with the exterior via the inlet 430 of the upper shell 20 and air outlets 110 in the lower base member 40. In operation, the intake manifold 10 accepts incoming air through inlet 430. The air then travels into the air intake and distribution chamber 395 and is drawn into the enclosed runner cavities 300 through inlets 340. From there, the air travels down a length of the respective enclosed runner cavities 300 and through the air outlets 110 formed in the lower base member 40, at which time the air flows into the inlet ports in the cylinder heads 80 and 90 of the engine 100.

The volume and velocity of air allowed through an intake manifold is limited by the size and shape of the inlet of the intake manifold. Generally speaking, the larger the inlet 430 of the intake manifold 10, the larger the volume of air that can be directed into the engine 100. Traditionally, intake manifold modification has been limited to altering only certain features, such as inlet size or air outlet size, because of the single component or permanently bonded types of construction. However, these features may be altered only to a degree, past which the part is no longer usable. Alternatively, intake manifold modification has constituted removing the installed intake manifold, obtaining an entirely new intake manifold with features of differing shapes or sizes, such a smaller or larger inlet, and attaching the new intake manifold to the engine. This process includes a substantial financial cost for both purchase of a new part and labor for installation. However, an intake manifold having the above-described construction solves these problems while, at the same time, adding two additional benefits.

First, the intake manifold 10 can be made to allow for a larger volume of air by simply removing the upper shell 20 having an inlet 430 of a given diameter, 78 mm for example, and replacing it with an upper shell 20 having an inlet 430 with a different diameter, 90 mm for example. Replacing only the upper shell 20 versus the entire intake manifold 10 results in a lower cost and less waste. Second, an added benefit of the present invention is the ability to change runner shape by removing and replacing the center runner section 30 with a new center runner section 30 having runner cavities 300 of a different shape. The shape of the runner cavities 300 directly affects how air flows within the intake manifold 10, and hence, how the air is delivered to the engine 100. Therefore, the interchangeability of the center runner section 30 is also advantageous from an engine tuning perspective. Third, by modular construction of the intake manifold, the upper shell 20 can be changed without having to disassemble the lower base member 40 from the engine 100. Therefore the seals between the mating faces 40 and 50, the gaskets 570, and the mating surfaces of the cylinder heads 80 and 90 remain intact. Accordingly, there is less risk of debris entering into the engine 100 and, therefore, less risk of internal engine damage.

Another beneficial aspect of the present invention is the use of witness marks 170. Intake manifolds 10 are commonly modified by a practice termed "porting", wherein material is removed from the interior surfaces 140 of the air outlets 110 of the lower base member 40. Porting improves airflow exiting the manifold 10. However, a common risk associated with porting is removal of too much material from the interior surfaces 140, eroding a surrounding portion of the right 60 or left 70 mating face abutted by the gasket 570, causing the gasket 570 to be drawn into or otherwise interfere with the performance of the engine 100. Therefore, two witness marks 170 are formed into opposing faces of the interior surface 140 of each air outlet 110. The depth of the witness marks 170 define the depth of material that may be removed by porting without the risk of the gaskets 570 becoming dislodged and being drawn into the engine 100. Therefore, the witness marks 170 provide a visual indicator as to how much material can be safely removed without causing the intake manifold 10 not to seal with the engine 100.

While there has been described what are at present considered to be preferred embodiments of the present invention, it will be understood that various modifications may be made thereto, and it is intended that the appended claims cover all such modifications as fall within the true spirit and scope of the invention. Other modifications will be apparent to those skilled in the art.

What is claimed is:

1. An intake manifold for an internal combustion engine having a three-piece construction comprising:

a lower base member having an internal cavity, an inlet provided at one end, a mating face, and a series of air outlets providing communication through the mating face;

a center runner section having an air intake and distribution chamber and a series of runner cavities with an inlet at one end that communicates with the air intake and distribution chamber and an outlet at an opposite end that extends to the air outlets within the lower base member; and an upper shell having a throttle body mounting boss, an inlet, and an upper portion for enclosing the runner cavities in the center runner section;

wherein the lower base member removably attaches to an upper portion of an internal combustion engine;

wherein the center runner section removably attaches to the lower base member and is situated within the internal cavity of the lower base member; and wherein the upper shell removably attaches to the lower base member and encloses the center runner section between the lower base member and the upper shell.

2. The intake manifold of claim 1, wherein the upper shell is removable from the intake manifold without removing the lower base member or center runner section.

3. The intake manifold of claim 1, wherein at least one of the lower base member, the center runner section, and the upper shell comprise a polymer.

4. The intake manifold of claim 1, wherein the center runner section is arc shaped defining the air intake and distribution chamber within the arch shape.

5. The intake manifold of claim 4, wherein the runner cavities are oriented transverse the inlet of the upper shell.

6. An intake manifold having a three-piece construction comprising:

a lower base member having an internal cavity, an inlet provided at one end, two mating face provided on opposite sides of the large internal cavity, and a series of air outlets providing communication through the mating faces;

a center runner section having an air intake and distribution chamber and a series of runner cavities with an inlet at one end that communicates with the air intake and distribution chamber and an outlet at an opposite end wherein the outlets of adjacent runner cavities extend in opposite directions to air outlets in opposing mating faces of the lower base member; and an upper shell having a throttle body mounting boss, an inlet, and an upper portion for enclosing the runner cavities in the center runner section;

wherein the lower base member removably attaches to an upper portion of an internal combustion engine;

wherein the center runner section removably attaches to the lower base member and is situated within the internal cavity of the lower base member; and wherein the upper shell removably attaches to the lower base member and encloses the center runner section between the lower base member and the upper shell.

7. The intake manifold of claim 6, wherein the upper shell is removable from the intake manifold without removing the lower base member or center runner section.

8. The intake manifold of claim 6, wherein at least one of the lower base member, the center runner section, and the upper shell comprise a polymer.

9. The intake manifold of claim 6, wherein the center runner section is arc shaped defining the air intake and distribution chamber within the arch shape.

10. The intake manifold of claim 9, wherein the runner cavities are oriented transverse to the inlet of the upper shell.

11. An intake manifold for an internal combustion engine having a three-piece construction comprising:

a lower base member having a large internal cavity, an inlet provided at one end, a mating face, and a series of air outlets providing communication through the mating face, wherein the outlets have internal surfaces with witness marks formed therein;

a center runner section having an air intake and distribution chamber and a series of runner cavities with an inlet at one end that communicates with the air intake and distribution chamber and an outlet at an opposite end that extends to the air outlets within the lower base member; and an upper shell having a throttle body mounting boss, an inlet, and an upper portion for enclosing the runner cavities in the center runner section;

wherein the lower base member removably attaches to an upper portion of an internal combustion engine;

wherein the center runner section removably attaches to the lower base member and is situated within the large internal cavity of the lower base member; and wherein the upper shell removably attaches to the lower base member and encloses the center runner section between the lower base member and the upper shell.

12. The intake manifold of claim 11, wherein the upper shell is removable from the intake manifold without removing the lower base member or center runner section.

13. The intake manifold of claim 11, wherein at least one of the lower base member, the center runner section, and the upper shell comprise a polymer.

14. The intake manifold of claim 11, wherein the center runner section is arc shaped defining the air intake and distribution chamber within the arch shape.

15. The intake manifold of claim 14 wherein the runner cavities are oriented transverse to the inlet of the upper shell.

* * * * *